US005841338A

United States Patent [19]

Yasukuni

[11] Patent Number: 5,841,338

[45] Date of Patent: Nov. 24, 1998

[54] FUSE COMBINATION, METHOD OF MAKING THE SAME, AND FUSE CIRCUIT INCLUDING THE SAME

[75] Inventor: Jun Yasukuni, Yokkaichi, Japan

[73] Assignee: Sumitomo Wiring Systems, Ltd., Japan

[21] Appl. No.: 843,333

[22] Filed: Apr. 15, 1997

[30] Foreign Application Priority Data

Apr. 17, 1996 [JP] Japan ..... 8-095737
Apr. 17, 1996 [JP] Japan ..... 8-095739

[51] Int. Cl.[6] ..... H01H 85/045; H01H 85/12; H01H 85/50

[52] U.S. Cl. ..... 337/293; 337/256; 337/229; 337/197; 337/198; 337/164

[58] Field of Search ..... 337/293, 297, 337/161, 181, 227, 229, 230, 256, 283, 197, 198, 164; 361/833

[56] References Cited

U.S. PATENT DOCUMENTS 4,349,802 9/1982 Gaia .
4,498,068 2/1985 Gaia .
4,544,907 10/1985 Takano ..... 337/262
4,560,227 12/1985 Bukala ..... 339/147 R
4,563,666 1/1986 Borzoni ..... 337/252
4,680,568 7/1987 Corrao et al. ..... 337/186
4,706,059 11/1987 Schmitt ..... 337/297

FOREIGN PATENT DOCUMENTS 0271449 6/1988 European Pat. Off. .
54-36726 11/1979 Japan .
61-14625 4/1986 Japan .
2195064 3/1988 United Kingdom .

*Primary Examiner*—Leo P. Picard
*Assistant Examiner*—Anatoly Vortman
*Attorney, Agent, or Firm*—Jordan B. Bierman; Bierman, Muserlian and Lucas

[57] ABSTRACT

A fuse combination in which a group of fused elements are placed on an insulative support. The support is bent into a U-shape carrying the fuse elements with it. Contacts at the ends of the fuse elements extend beyond the corresponding edges of the support and are adapted to be inserted into a socket. To make the combination, the fuse elements are stamped out of a metal plate which has a thin central section. This thin section becomes the fusible portions of the fuse elements. A band at either end of the fuse elements connects them so that they can be handled as a unit. They are then placed on the support, secured thereto, and a preferably transparent cover is placed over the fusible portions.

20 Claims, 6 Drawing Sheets

FUSE COMBINATION, METHOD OF MAKING THE SAME, AND FUSE CIRCUIT INCLUDING THE SAME

This Application claims the benefit of the priorities of Japanese Applications 8-95737 and 8-95739, both filed Apr. 17, 1996.

This Application is directed to a fuse combination including a plurality of fuse elements on an insulative support, as well as a method of making the combination and its use in an electrical circuit.

BACKGROUND OF THE INVENTION

A typical prior art device, on which the present Invention is an improvement, is shown in FIG. 11. Fuses 1 comprise fusible portions 2 which, in this case, are connected to a single unnumbered connector. Fuses 1 are stamped out of a conductive metal plate and, to predetermine the capacity of the fuses, fusible portions 2 are cut narrower than the remainder of the fuse. However, this is very difficult to do when stamping a metal plate, and thus is not entirely satisfactory. On the other hand, if a thinner metal plate is used, this will also cause the fusible portions to be thinner and permit control of the current flowing. However, the remainder of the fuses will also be thinner and will be difficult to connect to other terminals.

SUMMARY OF THE INVENTION

The present Invention is intended to provide a fuse combination which can be stamped from sheet metal and can be designed so that it will limit the circuit in which it is placed to a low current capacity. In addition, this Invention includes contacts of sufficient strength and thickness so that they can readily be inserted into other terminals.

There is provided a fuse combination having a plurality of fuse elements arranged in a plane on an insulative support. The fuse elements are generally elongated in shape and have first and second contacts with fusible portions therebetween. The latter are of shallower depths than the former.

The fuse elements are arranged in parallel and spaced apart from each other. A first band connects adjacent first contacts at their ends and, in a preferred form of the Invention, a second band connects the second contacts at their ends. In this way, the plurality of fuse elements is held in proper spaced relationship.

An insulative support, generally complementary to the plane of the fuse elements, is also provided. One dimension of the support is shorter than the distance between the ends of the fuse elements. In this way, the outer ends of the first and second contacts extend beyond the insulative support.

The support also is provided with cavities which correspond to the fusible portions of the fuse elements. The fusible portions are placed on the support so that the fusible elements traverse the cavities. In a preferred form of the Invention, the cavities are actually holes completely through the support. The fuse elements and the support are fixed together to complete the fuse combination.

Preferably, the combination is then bent into a U-shape about an axis transverse to the elongated fuse elements and passing through the cavities or holes. It has been found particularly useful if the support is weakened along the foregoing axis in order to provide a bending hinge.

A cover, preferably transparent, is placed over the fusible portions to protect them. Since the cover is transparent, if a fuse has melted, it can readily be determined by visual inspection. The combination, with the first and second contacts protruding beyond the support, can then be inserted into a complementary socket.

In the accompanying drawings, constituting a part hereof, and in which like reference characters indicate like parts, FIG. 1 is an exploded perspective view of the fuse elements and insulative support;

DETAILED DESCRIPTION OF THE INVENTION

Figure 1:
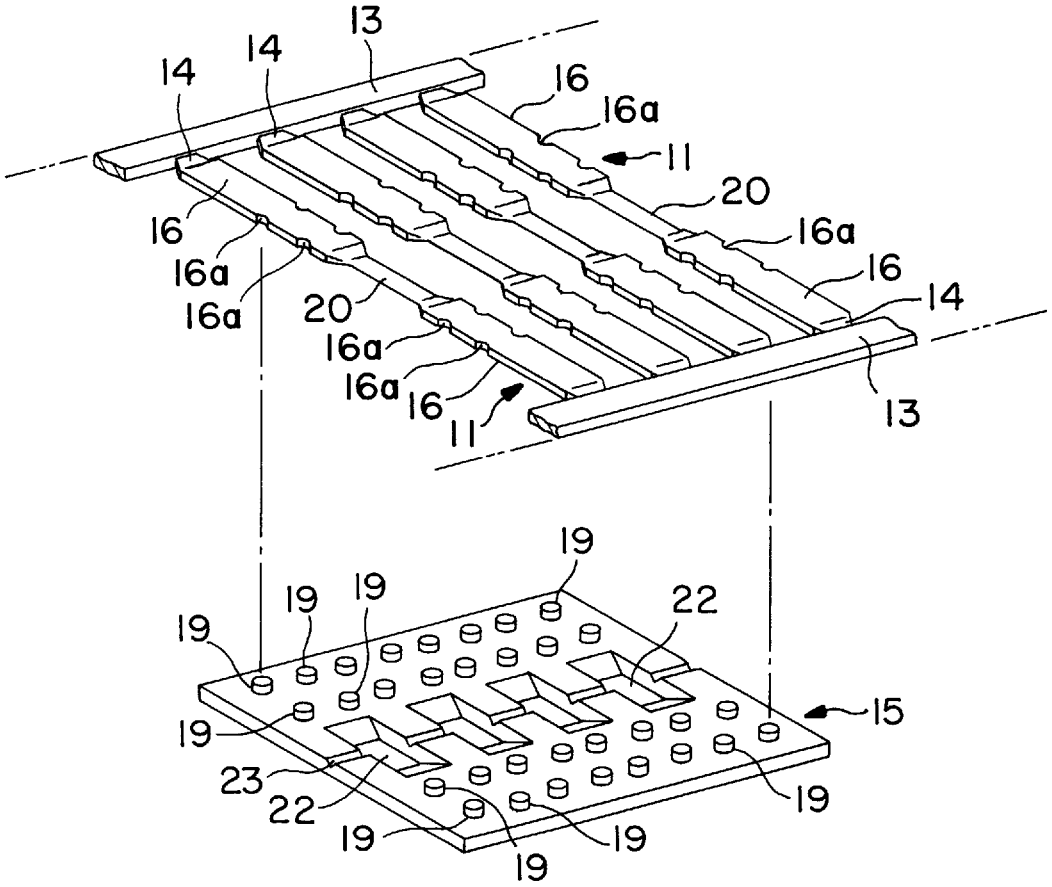

Metal plate 12 has first and second portions 12*a* with third portion 12*b* therebetween. Third portion 12*b* is preferably thinner than either of the other two portions. As shown in FIGS. 1 to 8, a plurality of fuse elements 11 is stamped out of metal plate 12. Each fuse element 11 consists of first and second contacts 16 and fusible portion 20. The ends of contacts 16 are attached to bands 13 by connecting portions 14.

Figure 6:
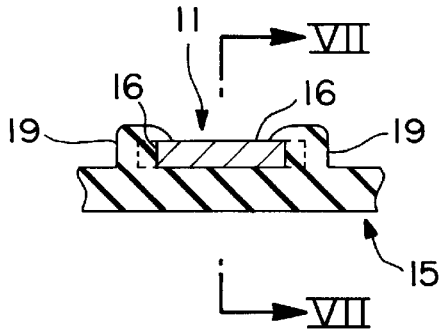
FIG. 6 is a fragmentary cross section of the support showing one manner of affixing the fuse elements thereto.
Figure 7:
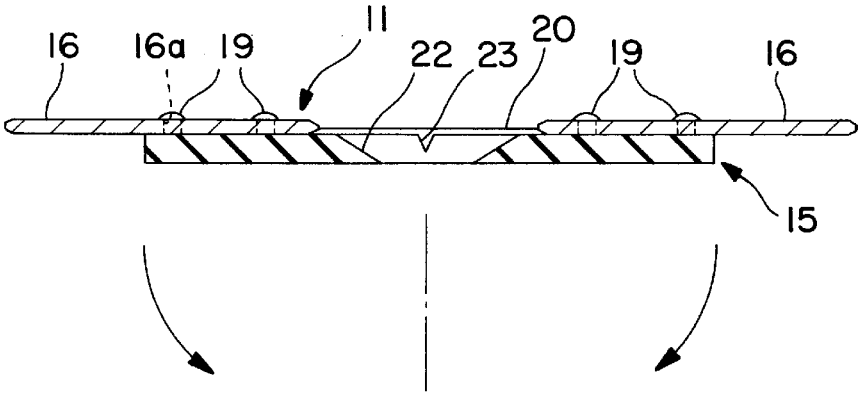
FIG. 7 is a cross section of the fuse combination prior to bending.
Figure 8:
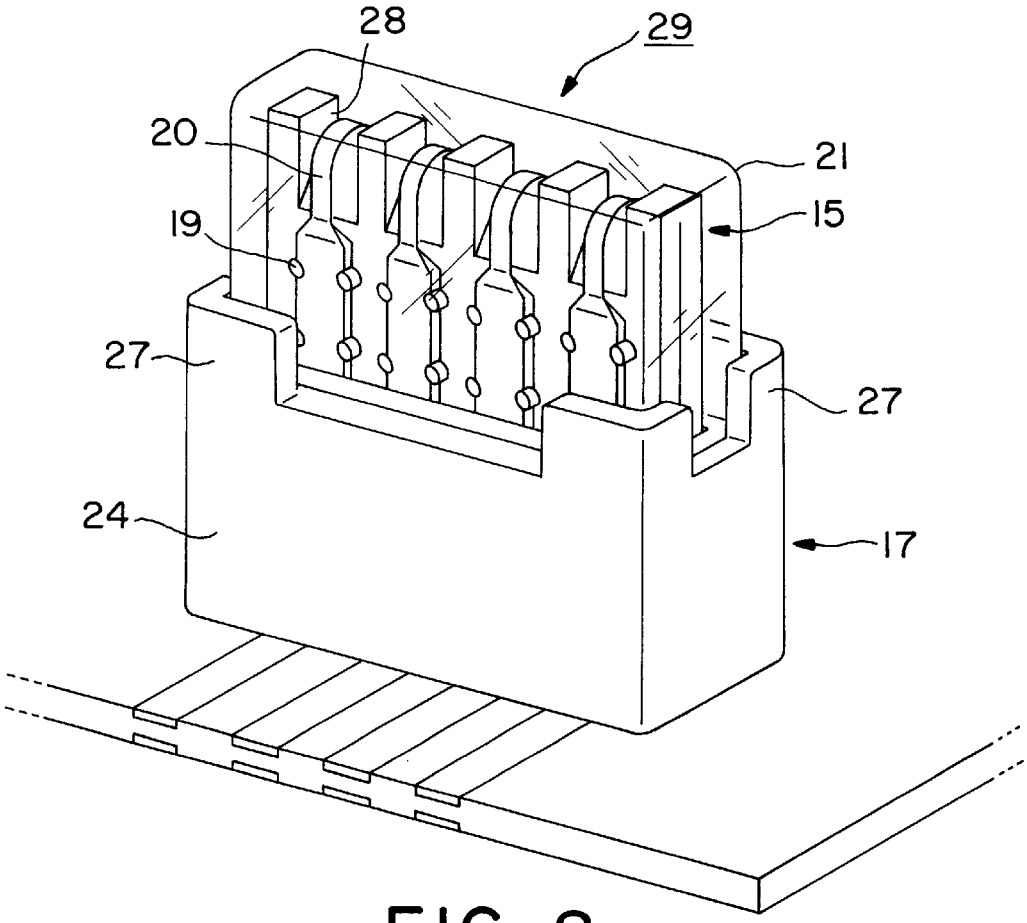
FIG. 8 is a perspective view of the fuse combination of the present Invention in a socket which, in turn, has had busbar contacts inserted therein.

Insulative support 15 is provided with openings 22 and locking projections 19. At hinge 23, support 15 is reduced in thickness to assist in bending. Fuse elements 11 are placed on support 15 so that locking projections 19 fit into notches 16*a*, thereby positioning fuse elements 11 as required. Projections 19 are higher than the thickness of contacts 16 and, as shown in FIG. 6, they are bent over the edges of the contacts in order to secure them to the insulative support. This can be accomplished, for example, by heat and pressure. Thereafter, bands 13 are removed by cutting connecting portions 14 and discarded.

Figure 2:
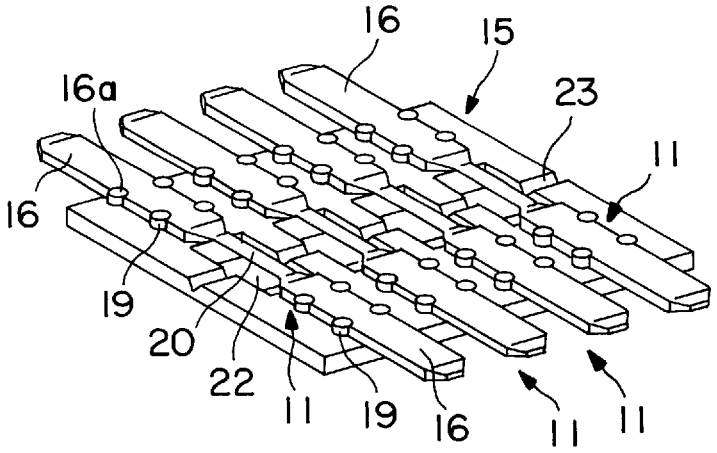
FIG. 2 is a perspective view of the fuse elements placed on the support.
Figure 3:
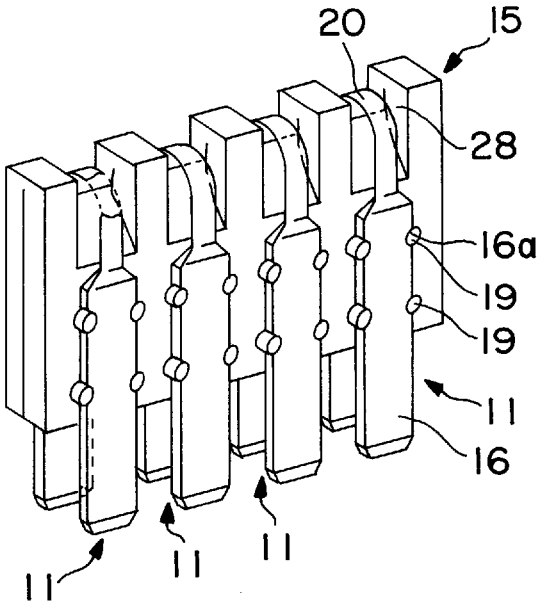
FIG. 3 is a perspective view of the fuse combination of FIG. 2 after it has been bent into the U-shape.

Referring more specifically to FIGS. 2 and 3, support 15 is then bent or folded about hinge 23 into the U-shape as shown in FIG. 3. Preferably, cover 21 is placed over at least fusible portions 20 for protection. It is preferred that cover 21 be transparent so that, if a fuse has melted due to a current overload, it can be visually detected.

Figure 4:
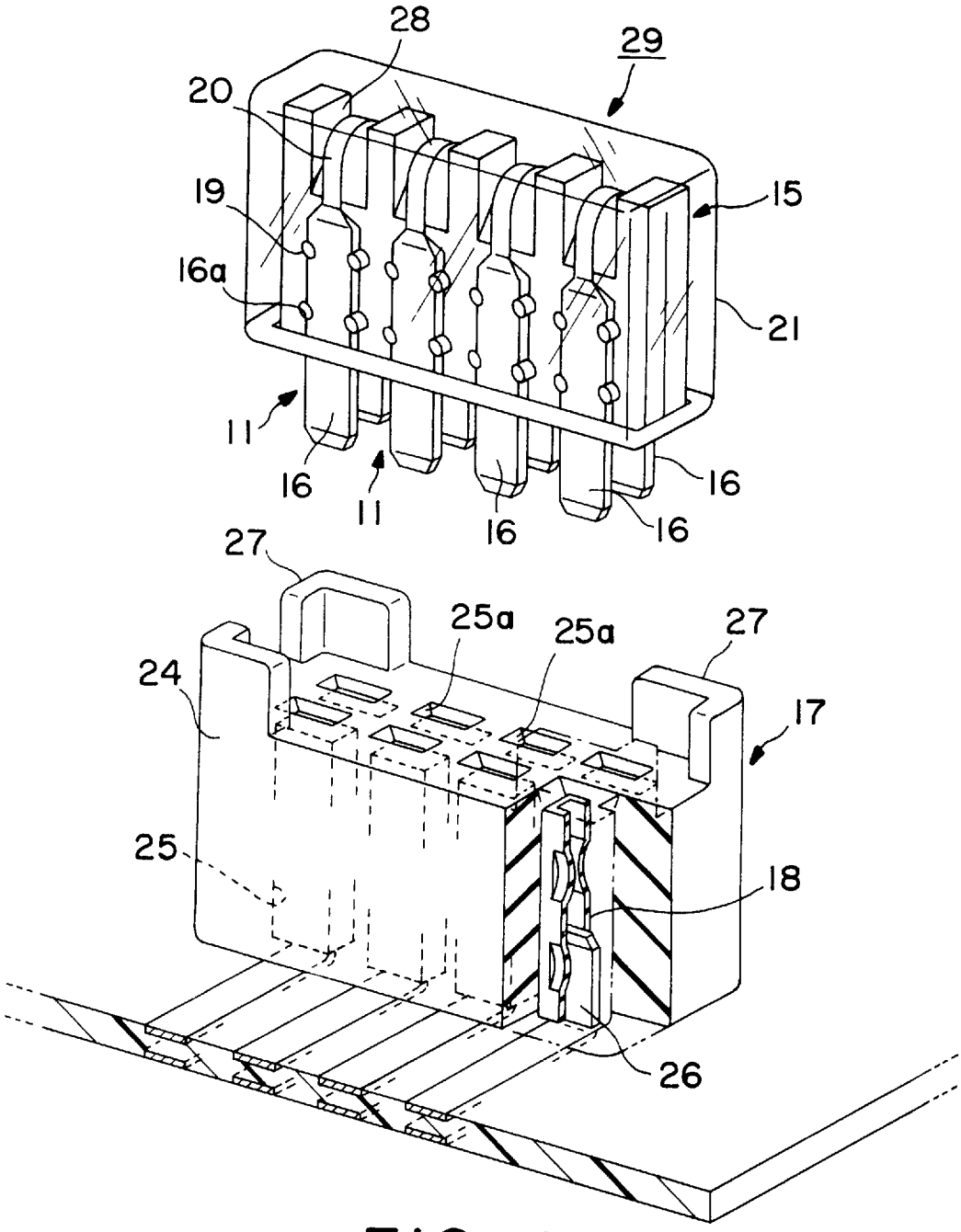
FIG. 4 is an exploded perspective view of the fuse combination as it is about to be inserted into a socket which has already received busbar contacts.
Figure 5:
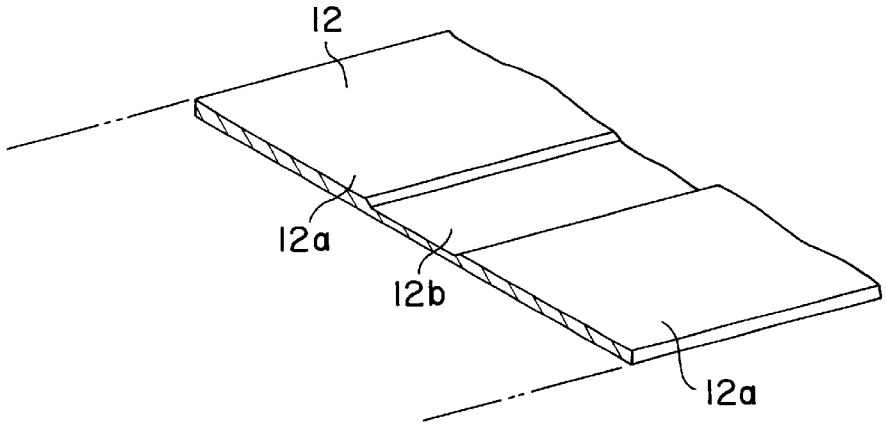
FIG. 5 is a perspective view, partly in section, of the metal plate from which the fuse elements of the present Invention are made.

Fuse combination is shown, for example, in FIG. 4 as it is about to be inserted into socket 17. Socket 17 contains a plurality, corresponding to the plurality of fuse elements 11, of terminal chambers 25. Busbar contacts 26 from, for example, a circuit board, extend up into the terminal chambers. Fuse combination 29 is pressed downwardly (as shown in FIG. 4) so that the outer walls of cover 21 fit into insertion walls 27. This properly positions fuse combination 29 and permits each of contacts 16 to enter its corresponding insertion opening 25*a*. When insulative support 15 is bent about hinge 23, cut out portions 28 are formed in which fusible portions 20 are located.

Figure 9:
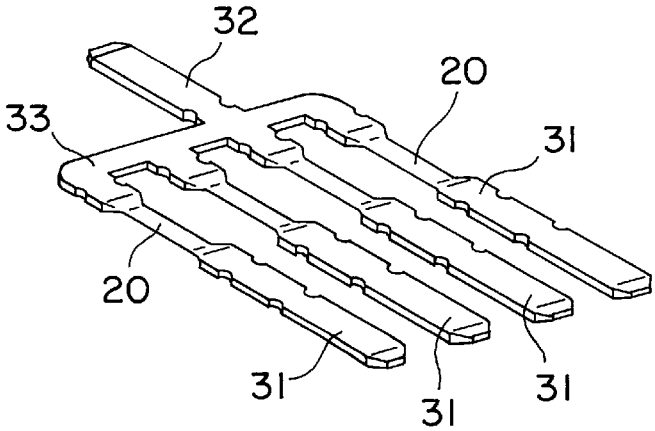
FIG. 9 is a perspective view of another embodiment of the fuse elements of the present Invention.
Figure 10:
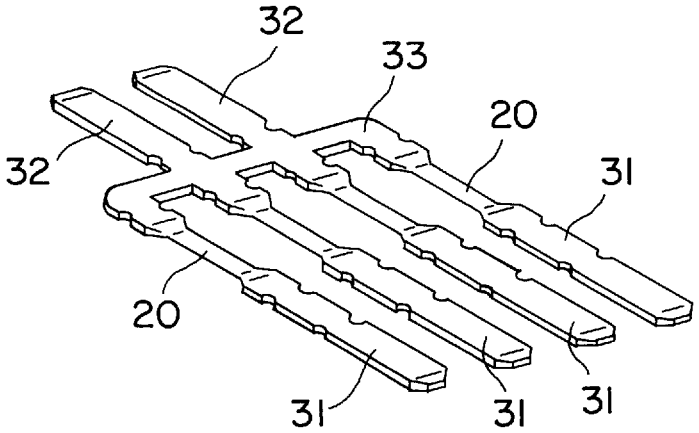
FIG. 10 is a view, similar to that of FIG. 9, of a further modification of the fuse elements of the present Invention.
Figure 11:
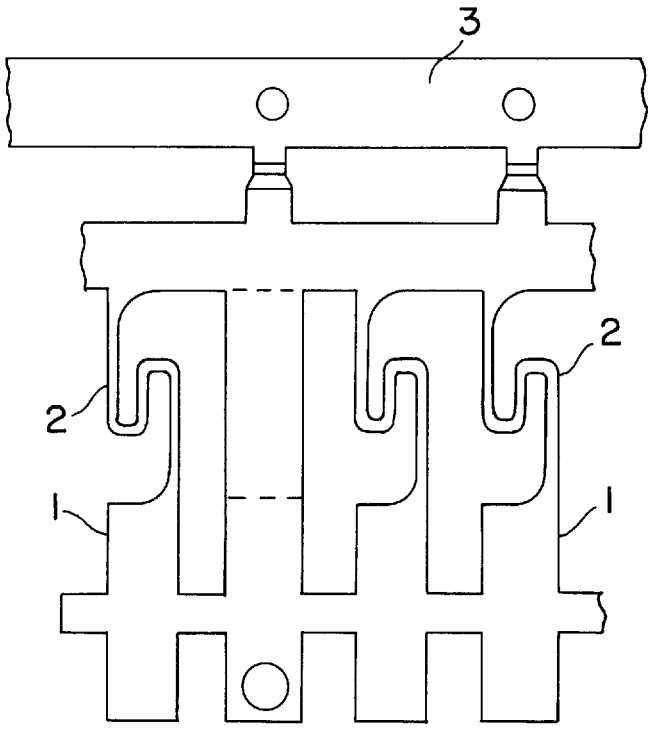
FIG. 11 PRIOR ART
FIG. 11 is a fragmentary plan view of a prior art device.

In a modification of the present Invention, as shown in FIG. 9, a branched fuse is provided. Fuse elements 31 are electrically connected by connecting piece 33 which, in turn, is joined to contact 32. In FIG. 10, a modification of the device of FIG. 9 is shown. This branched fuse has connecting piece 33 electrically uniting all of fuse elements 31. However, there are two contacts 32 for appropriate circuitry.

The present Invention, as described and claimed herein, has numerous advantages over the fuse combinations previously known. To predetermine the amount of current which the fuse will tolerate, it is necessary that the cross sections of the fusible portions of the fuse elements be carefully controlled. In accordance with the present Invention, this is accomplished by the provision of the metal plate having thick sections (which ultimately form the contacts) and a thin section (which ultimately forms the fusible portions).

Thus, by stamping or pressing the fuse elements from such a plate, the thicknesses of the fusible portions—and hence the maximum permitted current—can be easily controlled. The manufacturing process is quite simple and a large number of fuse elements can be produced at once. The thin portion of the metal plate can be readily and accurately formed by rolling or otherwise, thereby providing accurate control of the fusible portions and the current flowing therethrough. The Invention is of particular value where low current capacities are required.

Bands are provided on the ends of the fuse elements. These are formed at the same time—and in the same operation—as the fuse elements themselves. They serve to hold the elements in position with respect to each other so that the entire plurality may be handled at the same time. Once they are placed on the support, the latter can be bent into its U-shape, thereby forming all of the fuses in one operation. Grouping the fuses in this manner saves space and permits the fuses to be used in constricted areas. In addition, the structure of the inventive fuse combination permits insertion vertically into the receiving sockets. This minimizes the area required for installation and removal.

By providing openings through the support, the fusible portions are out of contact therewith. Thus, if a fusible portion melts, no smoke is generated, nor is any damage done to the support. Moreover, these openings allow dissipation of heat so that the substrate does not influence the melting of the fuse. This provides improved accuracy.

The provision of locking projections on the support and corresponding notches or holes in the contacts permits simple and foolproof attachment of the fuse elements. The projections position the fuse elements as well as retain them in position. Since the height of the projections is greater than that of the contacts, it is possible—as by the application of heat and/or pressure—to distort the ends of the projections so that they overlie edges or portions of the contacts. Alternatively, when holes are used, enlarged ends of the projections allow the fuse elements to be "snapped" into position and held there.

Since the undersides of the contacts are firmly affixed to the support, this tends to minimize variations in permitted current flow due to increases in temperature. The provision of a transparent cover not only protects the fusible portions, but also makes it possible to determine whether a fuse has melted by visual observation.

Although only a limited number of specific embodiments of the present Invention have been expressly disclosed, such changes as would be apparent to the person of ordinary skill may be made without departing from the scope or spirit thereof. For example, bands 13 can be eliminated and the fuse elements placed on the support individually. The support may first be bent and the fuse elements affixed thereafter.

If desired, the insulative support can be provided with two sets of projections, one for positioning the fuse elements and the other for locking them. Instead of locking projections, the fuse elements may be soldered directly to the support. Also, it is not essential that the fusible portions be suspended apart from the insulative support. They can lie flat thereon and still perform their function.

As shown in FIGS. 9 and 10, branching circuits may be formed having the fuses all connected to a single contact and, if desired, any number of fusible portions may be provided, depending upon individual requirements.

The foregoing, and other modifications of the present Invention, may be made without departing from the substance thereof. It is, therefore, to be broadly construed and not to be limited except by the character of the claims appended hereto.

What we claim is:

1. A fuse combination comprising a plurality of fuse elements arranged in a plane and an insulative support therefor, said fuse elements comprising first contacts at first ends of said fuse elements and second contacts at second ends of said fuse elements, and fusible portions between said first contacts and said second contacts, said first contacts having first depths, said second contacts having second depths, and said fusible portions having third depths, said third depths being thinner than said first depths or said second depths, said fuse elements in parallel and spaced apart relationship to each other in said plane, said support being generally complementary to said plane, having a dimension parallel to said plane and shorter than a distance between said first ends and said second ends, said support being provided with cavities corresponding to said fusible portions, said fuse elements being affixed to said support, said support, with said fuse elements secured thereto, being bent into a U-shape.

2. The combination of claim 1 wherein at least parts of said fusible portions extend over each of said cavities.

3. The combination of claim 1 wherein said fusible portions are enclosed in a transparent cover.

4. The fuse combination of claim 1 comprising a first band connecting adjacent said first ends whereby said elements are held in said relationship.

5. The combination of claim 4 wherein said first band is adapted to be severed from said first ends after said fusible elements are affixed to said support.

6. A method of making the fuse combination of claim 1 from said support and a metal plate having a first portion, a second portion, and a third portion therebetween, said method comprising formation of said fuse elements from said plate, whereby said first portion and said second portion constitute said first contacts and said second contacts, respectively, and said third portion constitutes said fusible portion, placement of said fuse elements on said support whereby said first contacts and said second contacts engage upstanding complementary units on said support, whereby said fuse elements are secured to said support, bending said support and said fuse elements into a U-shape about an axis passing through said cavities.

7. The method of claim 6 wherein said fusible portions are thinner than said first contact or said second contact.

8. The method of claim 6 wherein said units are locking projections which have a height greater than a thickness of said first contacts and said second contacts, said method comprising:

after said placement, distorting distal ends of said locking projections so that said distal ends overlie portions of said first contacts and said second contacts and said fuse elements are secured to said support.

9. The method of claim 8 wherein said distal ends are distorted by the application of heat and pressure.

10. The method of claim 6 wherein said units are locking projections having enlarged distal ends, said first contacts and said second contacts having holes corresponding to said projections, said method comprising:

pressing said first contacts and said second contacts onto said support whereby said holes are urged over said enlarged distal ends and said first elements are secured to said support.

11. The method of claim 7 wherein there is a first band connecting adjacent said first ends and a second band connecting adjacent said second ends, said method comprising severing said first band from said first contacts and said second band from said second contacts after said placement.

12. A fuse combination comprising a plurality of fuse elements arranged in a plane and an insulative support therefor, said fuse elements comprising first contacts at first ends of said fuse elements and second contacts at second ends of said fuse elements, and fusible portions between said first contacts and said second contacts, said first contacts having first depths, said second contacts having second depths, and said fusible portions having third depths, said third depths being thinner than said first depths or said second depths, said fuse elements in parallel and spaced apart relationship to each other in said plane, said support being generally complementary to said plane, having a dimension parallel to said plane and shorter than a distance between said first ends and said second ends, said support being provided with cavities corresponding to said fusible portions, said fuse elements being affixed to said support, said first contacts and said second contacts being provided with notched adjacent edges, there being complementary units on said support, said units bearing against said notches to secure said fuse elements to said support.

13. A fuse combination comprising a plurality of fuse elements arranged in a plane and an insulative support therefor, said fuse elements comprising first contacts at first ends of said fuse elements and second contacts at second ends of said fuse elements, and fusible portions between said first contacts and said second contacts, said first contacts having first depths, said second contacts having second depths, and said fusible portions having third depths, said third depths being thinner than said first depths or said second depths, said fuse elements in parallel and spaced apart relationship to each other in said plane, said support being generally complementary to said plane, having a dimension parallel to said plane and shorter than a distance between said first ends and said second ends, said support being provided with cavities corresponding to said fusible portions, said fuse elements being affixed to said support, there being upstanding locking projections with heights greater than thicknesses of said first contacts and said second contacts, said projections overlying portions of said first contacts and said second contacts.

14. A fuse combination comprising a plurality of fuse elements arranged in a plane and an insulative support therefor, said fuse elements comprising first contacts at first ends of said fuse elements and second contacts at second ends of said fuse elements, and fusible portions between said first contacts and said second contacts, said first contacts having first depths, said second contacts having second depths, and said fusible portions having third depths, said third depths being thinner than said first depths or said second depths, said fuse elements in parallel and spaced apart relationship to each other in said plane, said support being generally complementary to said plane, having a dimension parallel to said plane and shorter than a distance between said first ends and said second ends, said support being provided with cavities corresponding to said fusible portions, said fuse elements being affixed to said support, said first contacts and said second contacts being provided with holes therethrough, there being upstanding locking projections on said support passing through said holes, whereby said fuse elements are secured to said support.

15. The combination of claim 14 wherein said locking projections have enlarged distal ends adapted to retain said projections in said holes.

16. A fuse combination comprising a plurality of fuse elements arranged in a plane and an insulative support therefor, said fuse elements comprising first contacts at first ends of said fuse elements and second contacts at second ends of said fuse elements, and fusible portions between said first contacts and said second contacts, said first contacts having first depths, said second contacts having second depths, and said fusible portions having third depths, said third depths being thinner than said first depths or said second depths, said fuse elements in parallel and spaced apart relationship to each other in said plane, said support being generally complementary to said plane, having a dimension parallel to said plane and shorter than a distance between said first ends and said second ends, said support being provided with cavities corresponding to said fusible portions, said fuse elements being affixed to said support, said cavities being openings through said support.

17. A fuse combination comprising a plurality of fuse elements arranged in a plane and an insulative support therefor, said fuse elements comprising first contacts at first ends of said fuse elements and second contacts at second ends of said fuse elements, and fusible portions between said first contacts and said second contacts, said first contacts having first depths, said second contacts having second depths, and said fusible portions having third depths, said third depths being thinner than said first depths or said second depths, said fuse elements in parallel and spaced apart relationship to each other in said plane, said support being generally complementary to said plane, having a dimension parallel to said plane and shorter than a distance between said first ends and said second ends, said support being provided with cavities corresponding to said fusible portions, said fuse elements being affixed to said support, said support having a hinge transverse to said fusible portions, whereby said support, with said fuse elements secured thereto, is bent at said hinge into a U-shape.

18. A fuse combination comprising a plurality of fuse elements arranged in a plane and an insulative support therefor, said fuse elements comprising first contacts at first ends of said fuse elements and second contacts at second ends of said fuse elements, and fusible portions between said first contacts and said second contacts, said first contacts having first depths, said second contacts having second depths, and said fusible portions having third depths, said third depths being thinner than said first depths or said second depths, said fuse elements in parallel and spaced apart relationship to each other in said plane, said support being generally complementary to said plane, having a dimension parallel to said plane and shorter than a distance between said first ends and said second ends, said support being provided with cavities corresponding to said fusible portions, said fuse elements being affixed to said support, a socket having a plurality of insertion openings in a first surface thereof, said first contacts in said insertion openings and in electrical contact with terminals therein, an insertion wall on said surface and perpendicular thereto, a lower portion of a transparent cover in said insertion wall.

19. The combination of claim 18 wherein said terminals are busbars mounted on a circuit board.

20. The combination of claim 18 comprising busbars in said insertion openings in electrical contact with said first contacts.

* * * * *